US011047208B2

(12) United States Patent
Halily et al.

(10) Patent No.: US 11,047,208 B2
(45) Date of Patent: Jun. 29, 2021

(54) CHEMICAL INJECTION SYSTEM

(71) Applicant: SCHLUMBERGER TECHNOLOGY CORPORATION, Sugar Land, TX (US)

(72) Inventors: Soufiane Halily, Rosharon, TX (US); Emrah Gokdag, Houston, TX (US); Jerome Prost, Clamart (FR); Richa Bansal, Sugar Land, TX (US); Parvesh Singh, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 226 days.

(21) Appl. No.: 15/677,860

(22) Filed: Aug. 15, 2017

(65) Prior Publication Data

US 2019/0055812 A1 Feb. 21, 2019

(51) Int. Cl.

| | |
|---|---|
| ***E21B 34/06*** | (2006.01) |
| ***E21B 34/16*** | (2006.01) |
| ***E21B 43/16*** | (2006.01) |

(52) U.S. Cl.

CPC ..... *E21B 34/066* (2013.01); *E21B 34/16* (2013.01); *E21B 43/162* (2013.01)

(58) Field of Classification Search

CPC ..... E21B 34/066; E21B 34/16; E21B 43/126; E21B 43/162

See application file for complete search history.

(56) References Cited

U.S. PATENT DOCUMENTS

| | | | | |
|---|---|---|---|---|
| 4,896,722 | A * | 1/1990 | Upchurch | E21B 23/04 166/250.15 |
| 4,942,926 | A * | 7/1990 | Lessi | E21B 23/08 166/385 |
| 5,065,825 | A * | 11/1991 | Bardin | E21B 7/06 175/38 |
| 5,547,029 | A * | 8/1996 | Rubbo | E21B 34/10 166/375 |
| 6,179,052 | B1 * | 1/2001 | Purkis | E21B 23/04 166/53 |
| 2004/0040707 | A1 * | 3/2004 | Dusterhoft | E21B 43/267 166/279 |

(Continued)

FOREIGN PATENT DOCUMENTS

WO WO9839547 A2 9/1998

OTHER PUBLICATIONS

International Search Report and Written Opinion for corresponding PCT Application Serial No. PCT/US2018/000192, dated Jan. 7, 2019, 14 pages.

*Primary Examiner* — Giovanna Wright

(57) ABSTRACT

A technique facilitates both actuation of a well tool and chemical injection at a corresponding well zone or well zones. In a multi-zone operation, the well system may comprise a plurality of operating modules coupled with corresponding actuators and chemical injection devices. The well system is deployed downhole to a desired location in a borehole, e.g. a wellbore. The operating modules may be selectively shifted via electrical input to enable a desired chemical injection and/or actuation of the actuator (and thus the well tool) at desired well zones. In some embodiments, the operating modules may comprise contingency circuits to enable the chemical injection without electrical input.

16 Claims, 11 Drawing Sheets

(56) References Cited

U.S. PATENT DOCUMENTS

| | | | | |
|---|---|---|---|---|
| 2004/0149448 | A1 | 8/2004 | Akselberg | |
| 2006/0124318 | A1* | 6/2006 | Sheffield | E21B 47/12 166/381 |
| 2008/0296025 | A1 | 12/2008 | Inderberg et al. | |
| 2012/0067593 | A1* | 3/2012 | Powell | E21B 34/066 166/373 |
| 2012/0168146 | A1* | 7/2012 | Filas | E21B 23/04 166/66.5 |
| 2012/0318367 | A1 | 12/2012 | Going et al. | |
| 2016/0273321 | A1 | 9/2016 | Frosell et al. | |
| 2018/0283133 | A1* | 10/2018 | Poluchalla | E21B 34/066 |
| 2019/0071960 | A1* | 3/2019 | James | E21B 34/00 |

* cited by examiner

CHEMICAL INJECTION SYSTEM

BACKGROUND

Well systems are deployed downhole to enable a variety of operations related to production of desirable well fluids, e.g. hydrocarbon-based fluids such as oil. Some well systems comprised tubular well strings with chemical injection systems for injecting various chemicals into the wellbore and/or surrounding formation to facilitate production of well fluids. Additionally, well systems may comprise hydraulic actuators used to enable selective actuation of a corresponding device. In well applications, for example, hydraulic actuators may be coupled with a variety of well tools employed in production operations, injection operations, and/or other types of well related operations. Hydraulic fluid is supplied to the downhole actuator under pressure and used to actuate the hydraulic actuator and thus the corresponding well tool. The hydraulic fluid may be supplied via independent hydraulic control lines or other suitable fluid flow passages routed along the well string.

SUMMARY

In general, a system and methodology are provided for facilitating both actuation of a well tool and chemical injection at a corresponding well zone or well zones. In a multi-zone operation, the well system comprises a plurality of operating modules coupled with corresponding actuators and chemical injection devices, e.g. mandrels. The well system is deployed downhole to a desired location in a borehole, e.g. a wellbore. The operating modules may be selectively shifted via electrical input to enable a desired chemical injection and/or actuation of the actuator (and thus the well tool) at desired well zones. In some embodiments, the operating modules may comprise contingency circuits to enable the chemical injection without electrical input.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which may be used to facilitate actuation of devices in a variety of well and non-well applications. The technique may be employed to enable both actuation of a well tool and chemical injection at a corresponding well zone or well zones. In a multi-zone operation, the well system comprises a plurality of operating modules comprising or coupled with corresponding actuators and chemical injection devices. The actuators may be part of or coupled with flow control valves or other types of tools.

According to an embodiment, the well system is deployed downhole to a desired location in a borehole, e.g. a wellbore. The operating modules may be selectively actuated via electrical input to enable a desired chemical injection and/or actuation of the actuator (and thus the well tool) at desired well zones. In some embodiments, the operating modules may comprise contingency circuits to enable the chemical injection without electrical input.

For some downhole applications, an electrically operated module may include a manifold and may be used at each desired well zone to control a chemical injection line so that one chemical injection line may be used for multiple injection points. This electrically operated system may contain electrically operated valves, e.g. solenoid operated valves or proportional valves, to regulate the flow of chemicals. Consequently, a reduction in overall cost may be achieved by reducing the number of control lines running inside the well while enabling an increase in the number of well zones with chemical injection points without facing limits with respect to running out of penetrations at the wellhead or through packers. The system and methodology enable injection of the same chemical in several well zones simultaneously. In some embodiments, the rate of chemical injection may be adjusted on a zone by zone basis to, for example, match a production rate.

Figure 1:
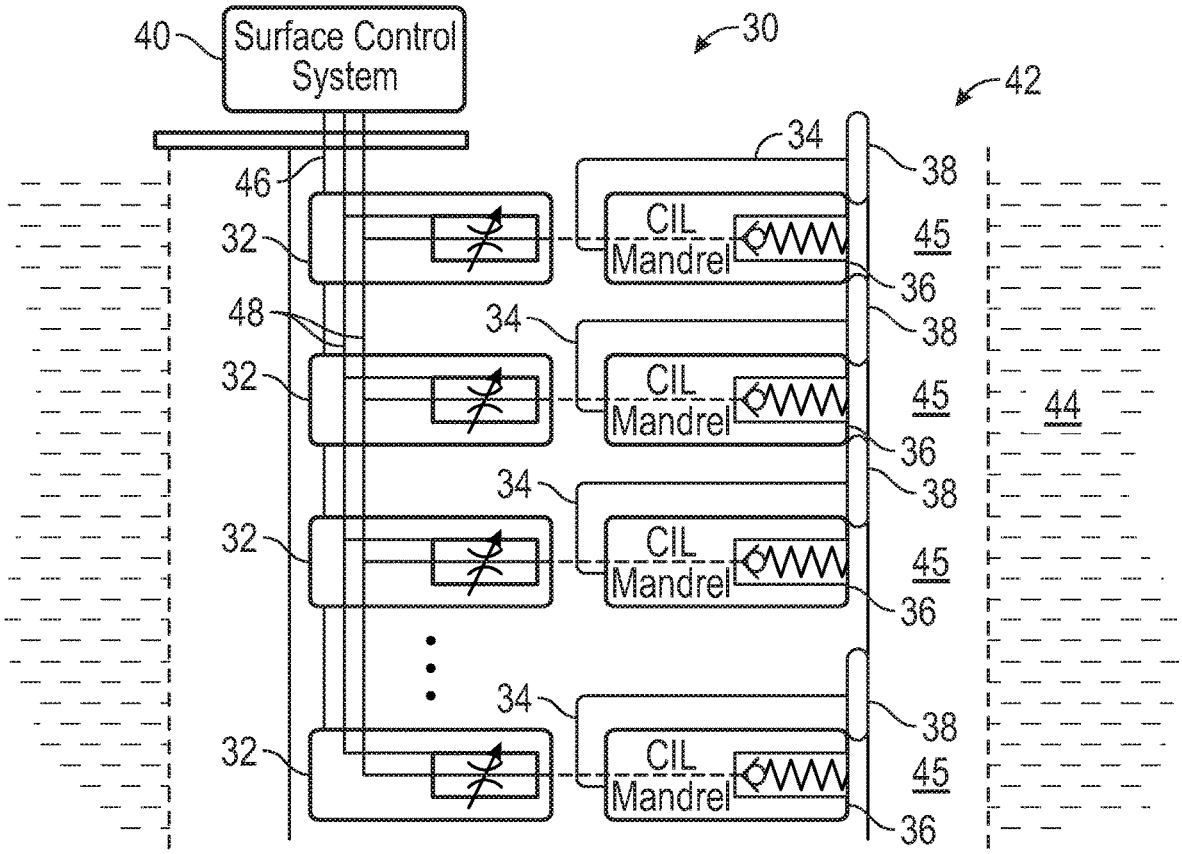
FIG. 1 is a schematic illustration of an example of a system employing a plurality of operating modules, actuators, and chemical injection devices, according to an embodiment of the disclosure.

Referring generally to FIG. 1, an example of a system 30 is illustrated as having a plurality of operating module 32 hydraulically coupled with a plurality of corresponding actuator systems 34 and chemical injection systems 36. As described in greater detail below, each actuator system 34 may comprise a hydraulically shiftable actuator coupled with a corresponding tool and each chemical injection system 36 may comprise a chemical injection mandrel through which chemicals are injected into a corresponding well zone.

As illustrated, the actuator systems 34 may be connected with a variety of corresponding devices 38, e.g. well tools, which are actuated according to signals provide from a control system 40, e.g. a surface control system. Similarly, the chemical injection systems 36 also may be actuated according to signals provided from control system 40. By way of example, control system 40 may be a computer-based control system or other processor-based control system programmed to provide the appropriate electrical and hydraulic signals. In the example illustrated, system 30 is a well system and the operating modules 32, actuator systems 34, chemical injection systems 36 and tools 38, e.g. flow control valves, are located in a borehole 42, e.g. wellbore, extending down into a subterranean geologic formation 44. However, system 30 may be used in a variety of non-well applications for controlling other types of devices/tools 38.

In the embodiment illustrated, the control system 40 is operatively coupled with the operating modules 32 via an electrical line 46 and hydraulic lines 48 which may include appropriate hydraulic control lines and chemical injection lines for a given well related operation. The control system 40 may be used to operate the plurality of operating modules 32 simultaneously. However, the control system 40 and the operating modules 32 may be constructed for individual actuation of selected operating modules 32 by utilizing control signals that are unique to each operating module 32. For example, unique electrical signals and/or hydraulic signals may be used to actuate individual operating modules 32 and thus individual devices 38 at specific well zones 45 of a plurality of well zones 45.

Figure 2:
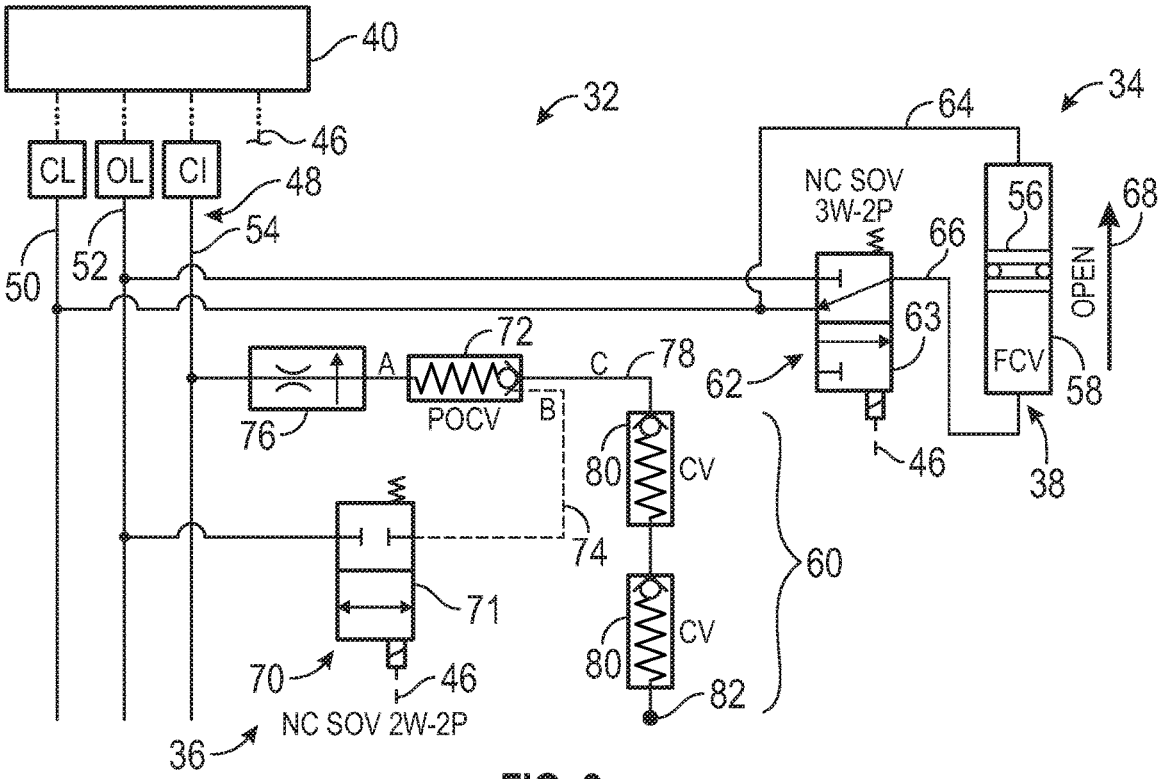
FIG. 2 is a schematic illustration of an example of an operating module coupled with an actuator and chemical injection device, according to an embodiment of the disclosure.

Referring generally to FIG. 2, an example of one of the operating modules 32 is illustrated. In this embodiment, the operating module 32 is connected with an electric line 46 and hydraulic lines 48 in the form of a close line 50, an open line 52, and a chemical injection line 54. Additionally, the operating module 32 comprises actuator system 34 hydraulically coupled with an actuator 56 of a corresponding tool 38 which in this example may be a flow control valve 58. The operating module 32 further comprises chemical injection system 36 which may be selectively operated via control system 40 to inject a chemical, e.g. a chemical carrying fluid, through a chemical injection mandrel 60.

By way of example, the actuation system 34 may comprise an electrically operated valve 62 coupled with close line 50, open line 52, and electric line 46. The electrically operated valve 62 also is hydraulically coupled with actuator 56 via hydraulic lines 64, 66. In the illustrated example, the electrically operated valve 62 is in the form of a normally open three way, two position solenoid operated valve 63. However, other types of electrically actuated valves may be used to control flow of the hydraulic fluid to actuator 56.

When control system 40 actuates valve 62 to an open flow position, hydraulic actuating fluid flows through open line 52, through valves 62, and through hydraulic line 66 to shift the actuator 56 in an open direction illustrated by arrow 68. To move actuator 56 in a close direction, control system 40 directs actuating fluid through close line 50 and hydraulic line 64 to shift the actuator 56 in a close direction opposite to the open direction.

The operating module 32 also comprises chemical injection system 36 which includes an electrically operated valve 70 coupled with hydraulic open line 52 and electric line 46. By way of example, the electrically operated valve 70 may be in the form of a normally closed two-way, two position solenoid operated valve 71. The electrically operated valve 70 also is coupled with a normally closed pilot operated check valve 72 via a hydraulic connector line 74 which engages a B port of the pilot operated check valve 72 as illustrated.

The pilot operated check valve 72 also comprises an A port which is coupled with chemical injection line 54 via a flow control device 76. By way of example, the flow control device 76 may be a Flosert™ device available from LEE Company of Connecticut, USA. Additionally, the pilot operated check valve 72 is connected to mandrel 60 via a hydraulic connector line 78 coupled with a C port of the pilot operated check valve 72 as illustrated. The chemical injection mandrel 60 may comprise a check valve 80 or a plurality of check valves 80 through which the chemical injection fluid flows before exiting into the surrounding borehole 42 via nozzle 82.

Figure 3:
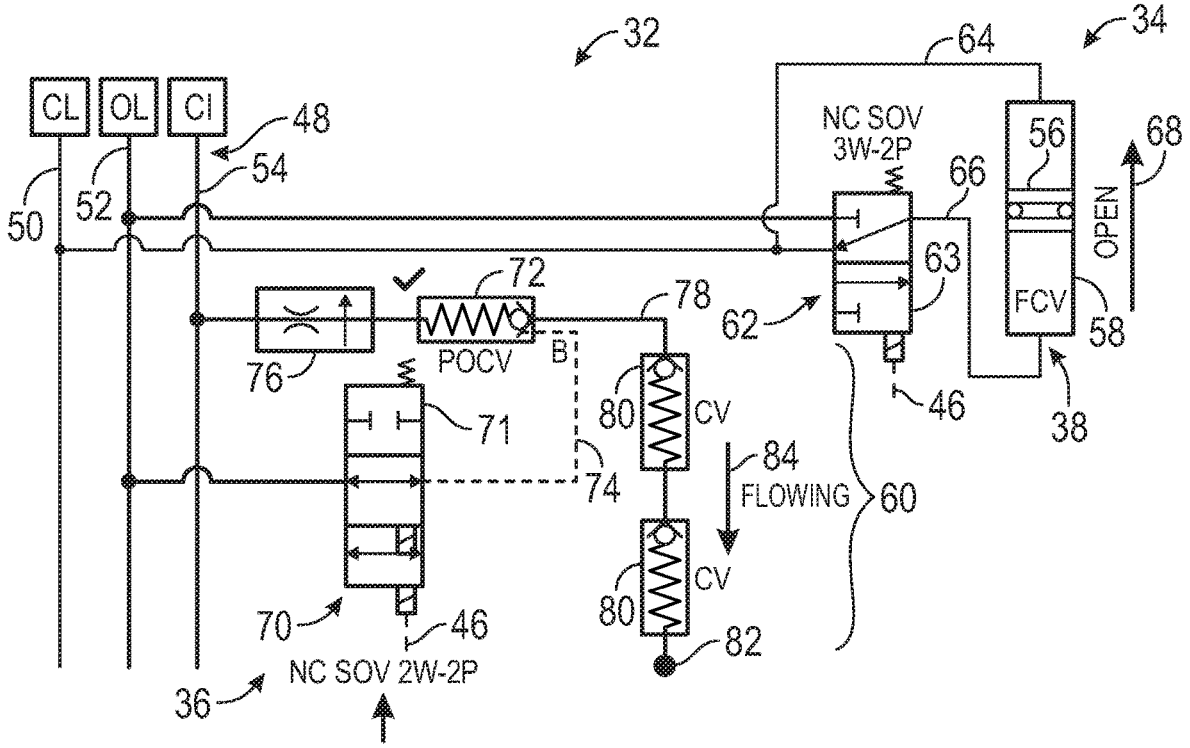
FIG. 3 is a schematic illustration similar to that of FIG. 2 but showing the operating module in a different operational position, according to an embodiment of the disclosure.

According to an operational example, a chemical injection operation is initiated by pressuring up chemical injection line 54 and open line 52. An electrical input is then provided to the solenoid operated valve 71 so as to actuate the valve 71, as illustrated in FIG. 3. In other words, the solenoid operated valve 71 is shifted from the position illustrated in FIG. 2 to the different operational position (actuated position) illustrated in FIG. 3.

As a result, pressurized hydraulic fluid is able to flow through valve 71, through hydraulic connector line 74, and to the normally closed pilot operated check valve 72. The pressurized hydraulic fluid opens check valve 72 to enable injection of the desired chemical into borehole 42 through mandrel 60 as indicated by arrow 84. The solenoid operated valve 71 may then be de-energized and the pressure in open line 52 may be decreased to bleed down the open line 52.

To subsequently stop the injection of chemicals, the solenoid operated valve 71 is again actuated to the position illustrated in FIG. 3. Because the pressure in open line 52 has been reduced, the trapped volume of fluid in hydraulic connector line 74 is able to bleed out. As the pressure in hydraulic line 74 decreases, the pilot operated check valve 72 closes and the injection of chemicals stops. At this stage, the solenoid operated valve 71 may again be de-energized. It should be noted the electrical and hydraulic inputs may be controlled via control system 40. The control system 40 also may be operated to energize or de-energize solenoid operated valve 63 to enable desired shifting of actuator 56 and tool 38.

Figure 4:
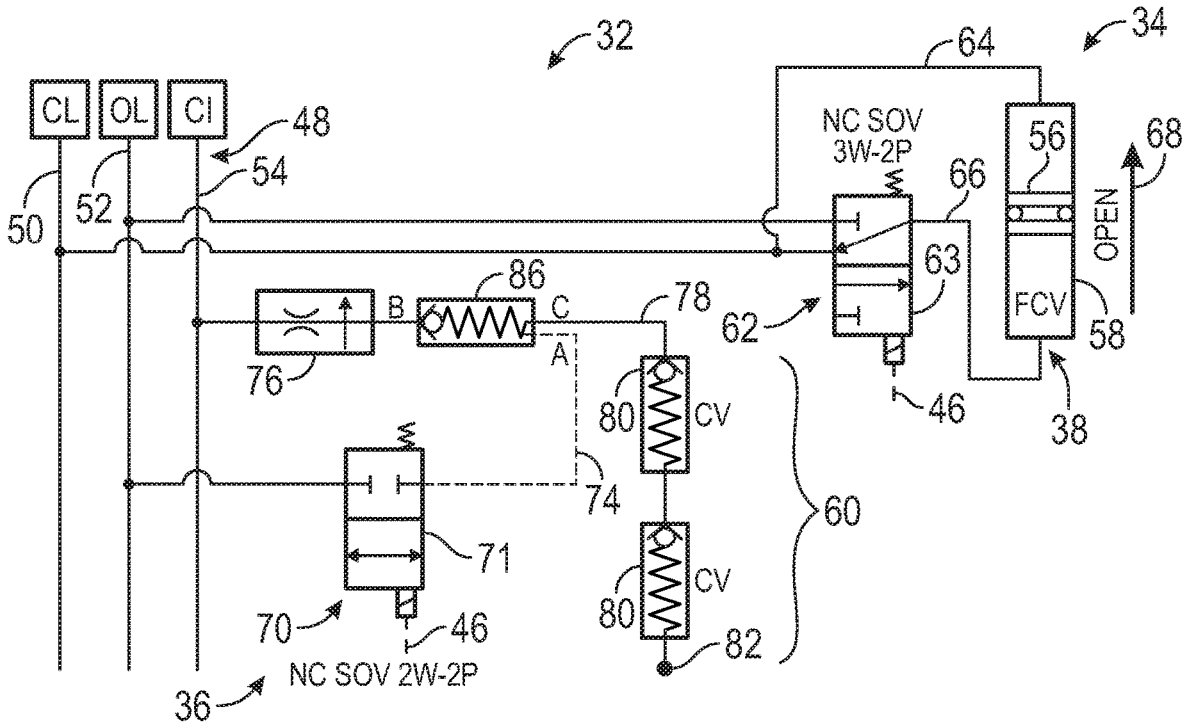
FIG. 4 is a schematic illustration of another example of an operating module coupled with an actuator and chemical injection device, according to an embodiment of the disclosure.
Figure 5:
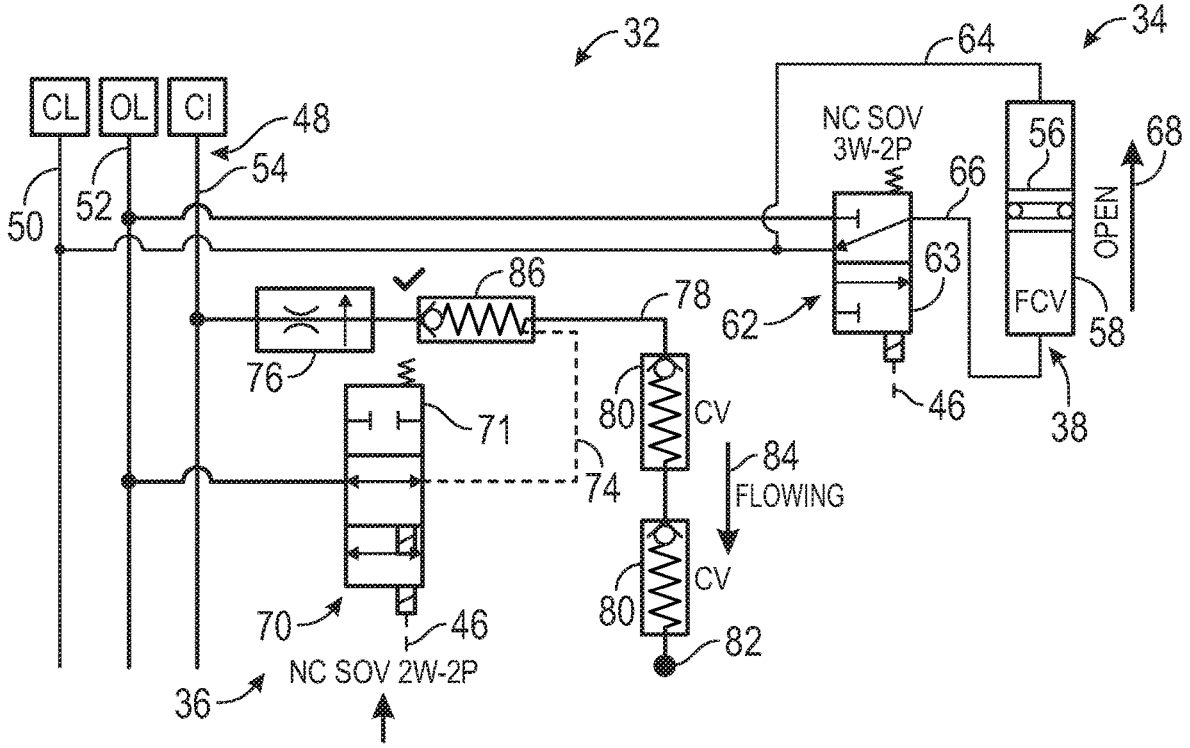
FIG. 5 is a schematic illustration similar to that of FIG. 4 but showing the operating module in a different operational position, according to an embodiment of the disclosure.

Referring generally to FIGS. 4 and 5, another embodiment of operating module 32 is illustrated. In this example, the normally closed pilot operated check valve 72 illustrated in FIGS. 2, 3 has been replaced by a normally open pilot operated check valve 86. To initiate a chemical injection operation, chemical injection line 54 is simply pressured up and the pressurized chemical injection fluid flows through the flow control device 76, through the normally open pilot operated check valve 86, through check valves 80 of mandrel 60, and into the surrounding well zone 45 via nozzle 82.

To stop the injection of chemicals, the hydraulic open line 52 is pressured up and the solenoid operated valve 71 is actuated to the position illustrated in FIG. 5. The pressurized actuating fluid in open line 52 is then able to flow through solenoid operated valve 71, through hydraulic connector line 74, and into the pilot operated check valve 86 to close the pilot operated check valve 86. Once the pilot operated check valve 86 is closed, the solenoid operated valve 71 may be de-energized to trap the pressurized fluid in hydraulic connector line 74 and to thus maintain the pilot operated check valve 86 in the closed position. Subsequently, the pressurized fluid in hydraulic open line 52 may be bled off. The actuator system 34 may be controlled as described above.

Figure 6:
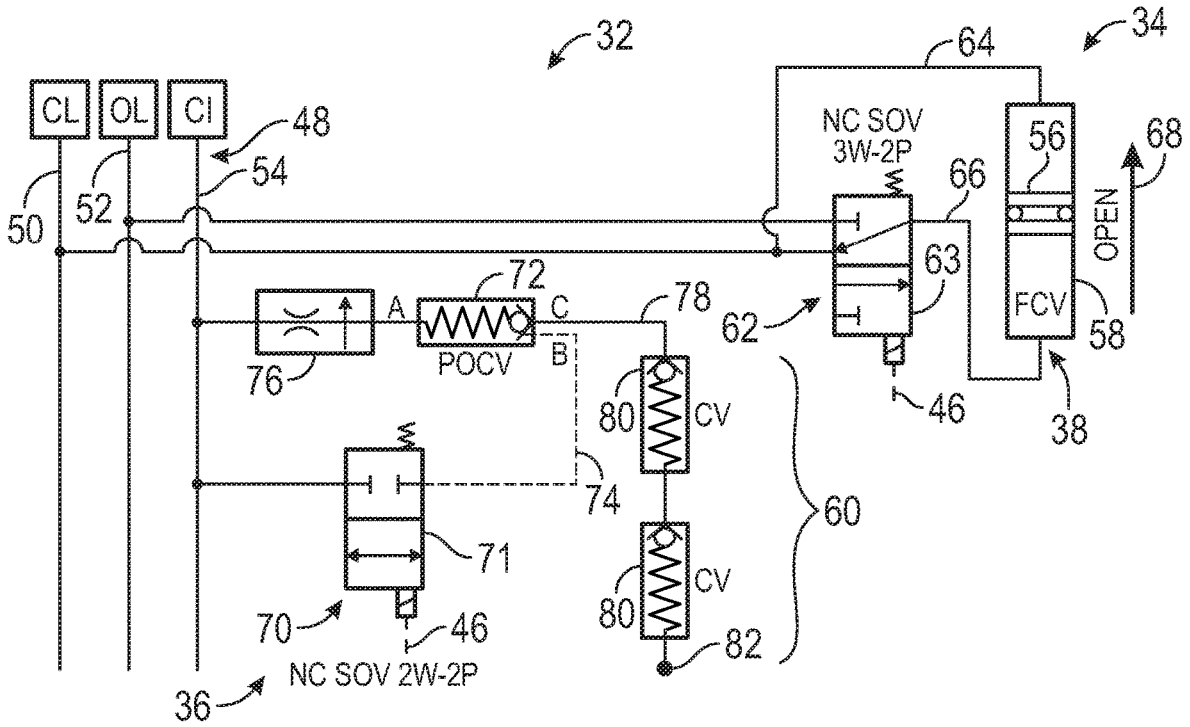
FIG. 6 is a schematic illustration of another example of an operating module coupled with an actuator and chemical injection device, according to an embodiment of the disclosure.
Figure 7:
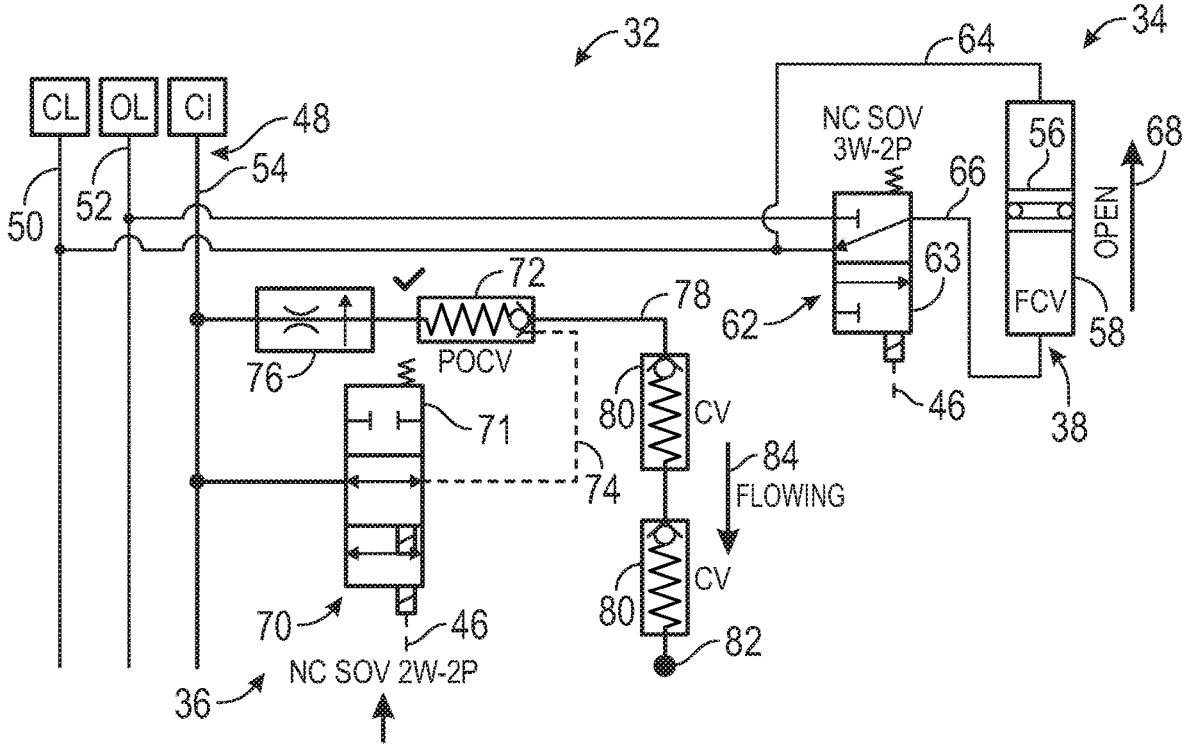
FIG. 7 is a schematic illustration similar to that of FIG. 6 but showing the operating module in a different operational position, according to an embodiment of the disclosure.

Referring generally to FIGS. 6 and 7, another embodiment of operating module 32 is illustrated. In this example, the normally closed pilot operated check valve 72 is again employed in the chemical injection circuit. In this embodiment, however, the electrically operated valve 70, e.g. solenoid operated valve 71, is coupled directly with the chemical injection line 54.

According to an operational example, an injection operation may be initiated by pressuring up chemical injection line 54 to a suitable actuation pressure. The solenoid operated valve 71 is then actuated to the position illustrated in FIG. 7. This allows the pressurized chemical injection fluid to flow through solenoid operated valve 71, through connector hydraulic line 74, and to the normally closed pilot operated check valve 72, thus opening check valve 72. Once check valve 72 is in an open flow position, chemical injection fluid is able to flow through mandrel 60 and into the corresponding well zone 45 as indicated by flow arrow 84. The solenoid operated valve 71 may then be de-energized and the pressure of the chemical injection fluid in chemical injection line 54 may be adjusted to a desired pressure level to provide a desired flow through mandrel 60.

To stop the injection procedure, the pressure in chemical injection line 54 is reduced to bleed the chemical injection line 54 and to thus stop the injection of fluid. The solenoid operated valve 71 may then be actuated to bleed out fluid trapped in hydraulic connector line 74. This will effectively close the normally closed pilot operated check valve 72 and prevent any further flow of injection fluid therethrough. The solenoid operated valve 71 may then be de-energized and thus transitioned to the position illustrated in FIG. 6.

Figure 8:
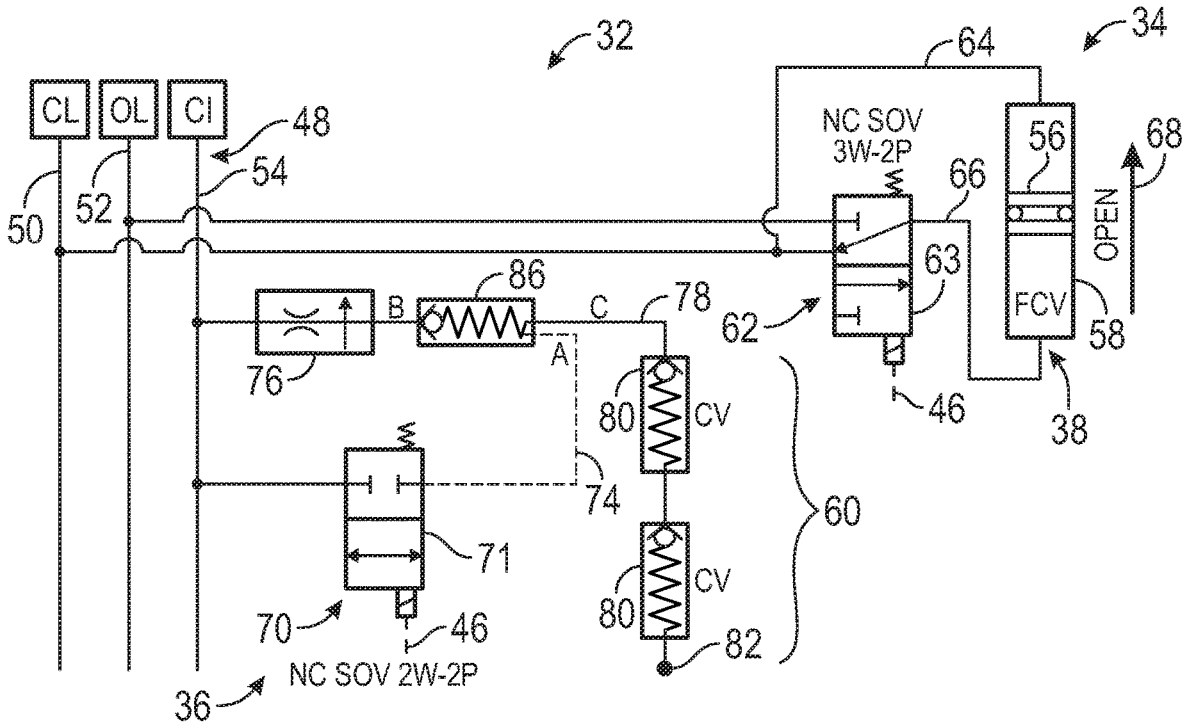
FIG. 8 is a schematic illustration of another example of an operating module coupled with an actuator and chemical injection device, according to an embodiment of the disclosure.

Referring generally to FIG. 8, another embodiment of operating module 32 is illustrated. In this example, the circuit configuration of operating module 32 is similar to that illustrated in FIGS. 6 and 7. However, the normally closed pilot operated check valve 72 illustrated in FIGS. 6, 7 has been replaced by the normally open pilot operated check valve 86. To initiate a chemical injection operation, chemical injection line 54 is simply pressured up and the pressurized chemical injection fluid flows through the flow control device 76, through the normally open pilot operated check valve 86, through check valves 80 of mandrel 60, and into the surrounding well zone 45 via nozzle 82.

To stop the injection of chemicals, the solenoid operated valve 71 is actuated to a flow-through position. The pressurized chemical injection fluid is then able to flow through solenoid operated valve 71, through hydraulic connector line 74, and into the pilot operated check valve 86 to close the pilot operated check valve 86. Once the pilot operated check valve 86 is closed, the solenoid operated valve 71 may be de-energized to trap the pressurized fluid in hydraulic connector line 74 and to thus maintain the pilot operated check valve 86 in the closed position. Again, the actuator system 34 may be controlled as described above.

Figure 9:
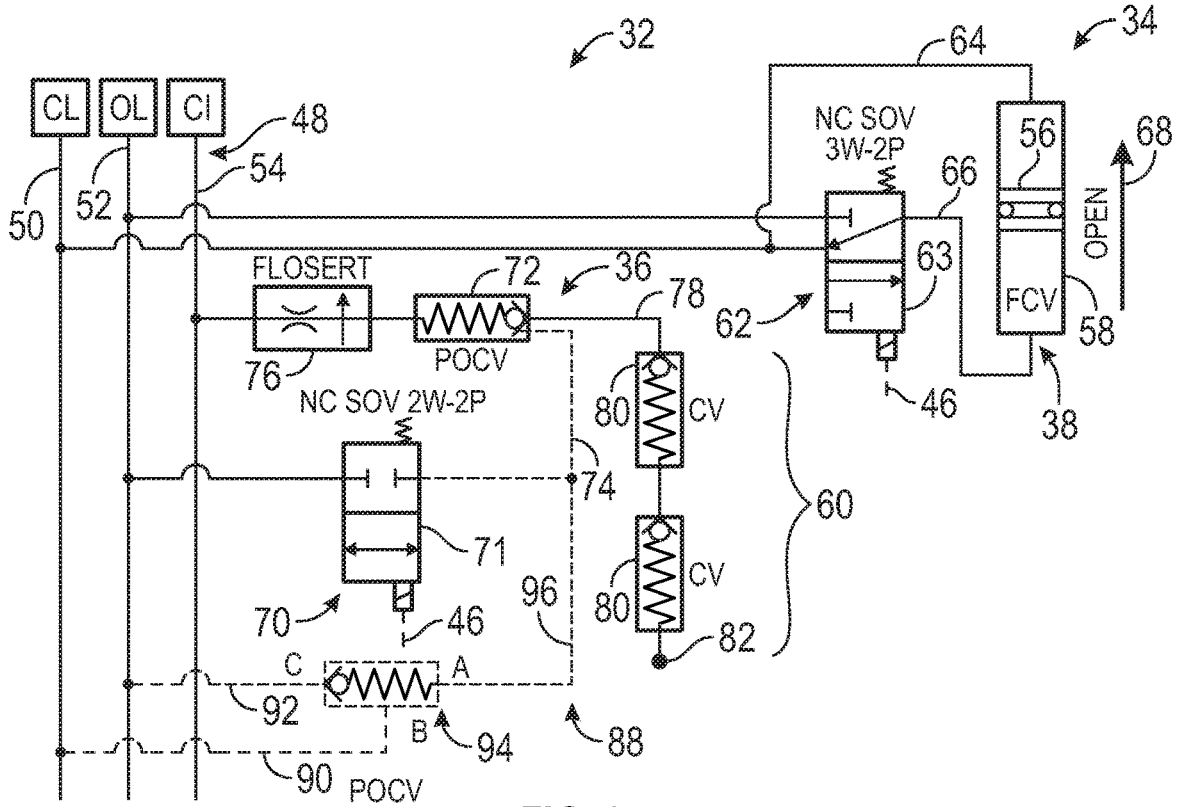
FIG. 9 is a schematic illustration of another example of an operating module coupled with an actuator and chemical injection device, according to an embodiment of the disclosure.
Figure 10:
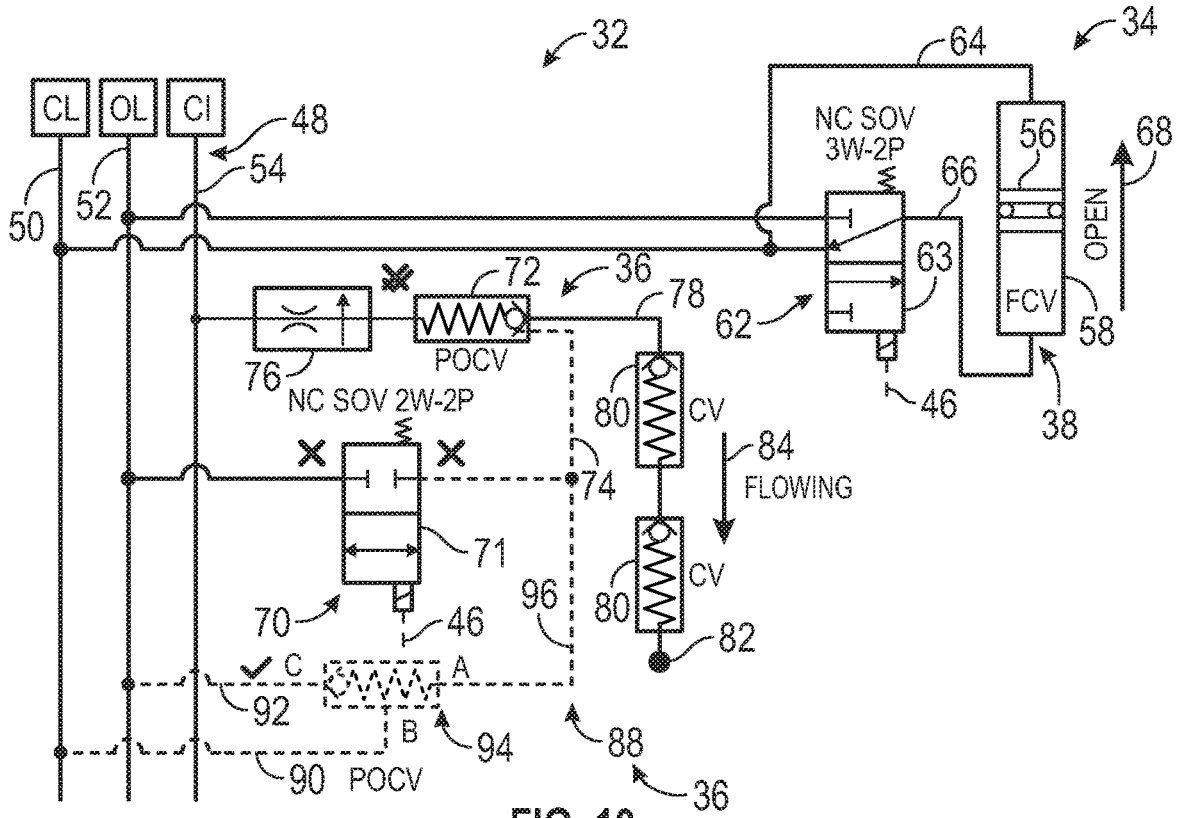
FIG. 10 is a schematic illustration similar to that of FIG. 9 but showing the operating module in a different operational position, according to an embodiment of the disclosure.

Referring generally to FIGS. 9 and 10, another example of operating module 32 is illustrated. In this embodiment, the chemical injection system 36 comprises a contingency circuit 88 to enable injection of the desired chemical or chemicals without electrical power. For example, the contingency circuit 88 enables chemical injection in the event electrical power is interrupted or no longer available.

In this example, the contingency circuit 88 is combined with a chemical injection circuit similar to that illustrated in FIGS. 2 and 3. The contingency circuit 88 comprises hydraulic connector lines 90, 92 coupled with close line 50 and open line 52, respectively. The hydraulic connector lines 90, 92 also are coupled with corresponding ports B, C of a normally open pilot operated check valve 94. Additionally, a port A of the pilot operated check valve 94 is coupled with a hydraulic connector line 96 which is in fluid communication with hydraulic connector line 74.

According to an operational example in which contingency circuit 88 is utilized, the chemical injection may be stopped without electrical input by pressuring up close line 50. The increased pressure in close line 50 causes the pilot operated check valve 94 to stay in an open position thus allowing bleeding of trapped pressure through open hydraulic line 52. Consequently, the pilot operated check valve 72 closes and the injection of fluid is stopped. The close line 50 may then be bled to cause closure of the pilot operated check valve 94.

Contingency injection (without electrical power) may then be initiated when open line 52 is pressured up and the flow of pressurized actuating fluid moves through pilot operated check valve 94, hydraulic connector line 96, hydraulic connector line 74, and to pilot operated check valve 72, thus opening check valve 72. Once the check valve 72 is in an open flow position, the chemical injection line 54 may be pressured up to initiate injection of the desired chemical or chemicals through nozzle 82 (see arrow 84 in FIG. 10). Closure of check valve 94 by bleeding off pressure effectively traps pressurized fluid in hydraulic connector lines 96, 74 and maintains pilot operated check valve 72 in an open position for injection of chemicals.

Figure 11:
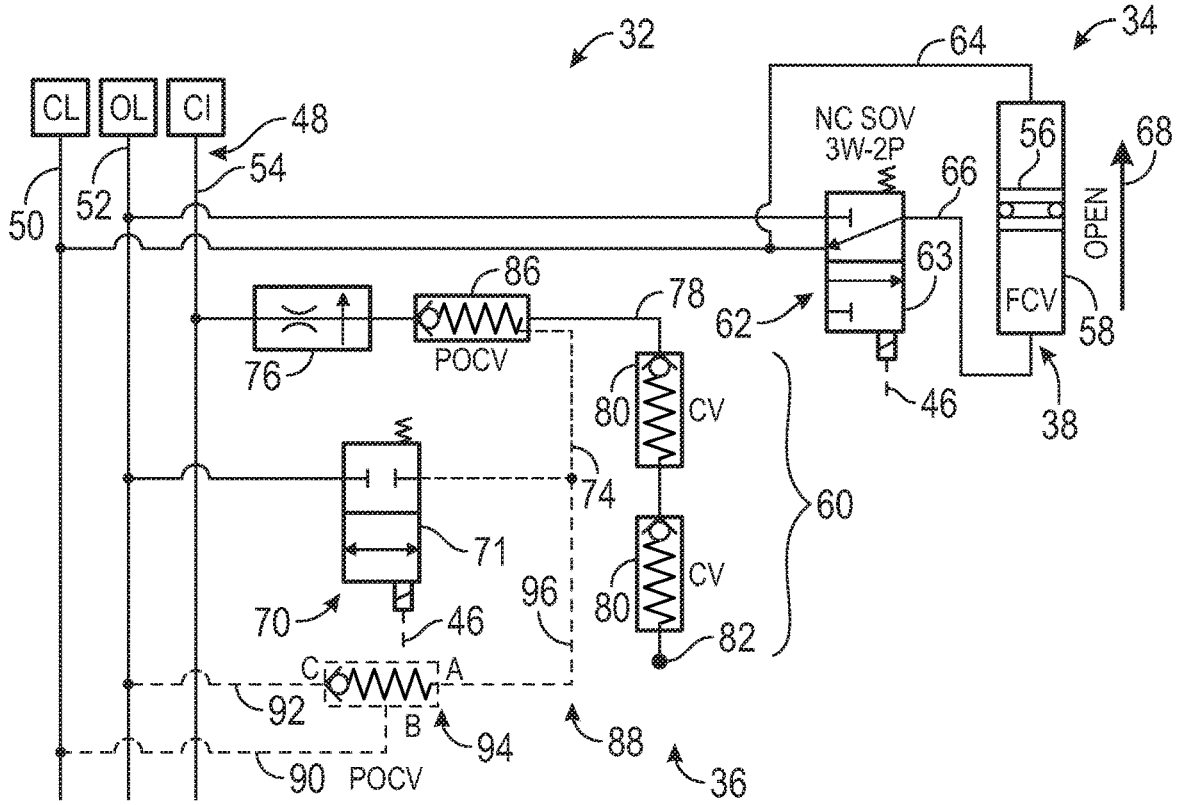
FIG. 11 is a schematic illustration of another example of an operating module coupled with an actuator and chemical injection device, according to an embodiment of the disclosure.
Figure 12:
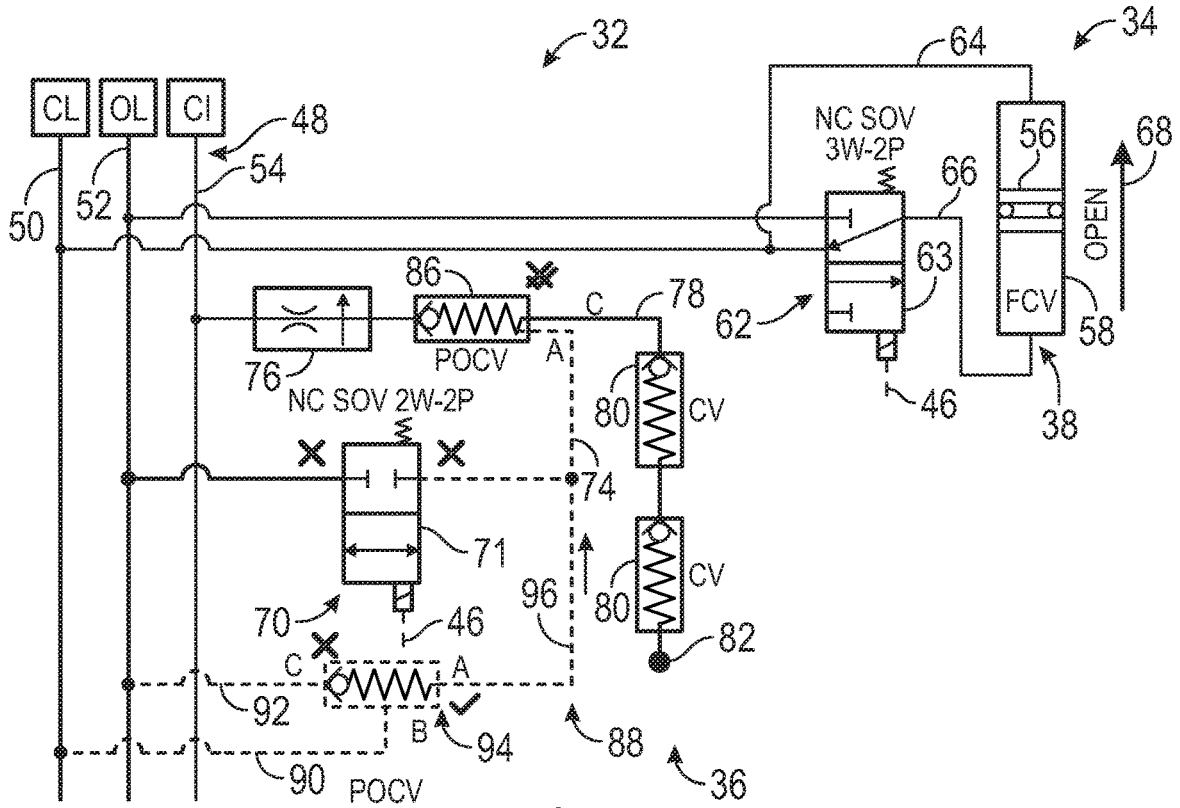
FIG. 12 is a schematic illustration similar to that of FIG. 11 but showing the operating module in a different operational position, according to an embodiment of the disclosure.
Figure 13:
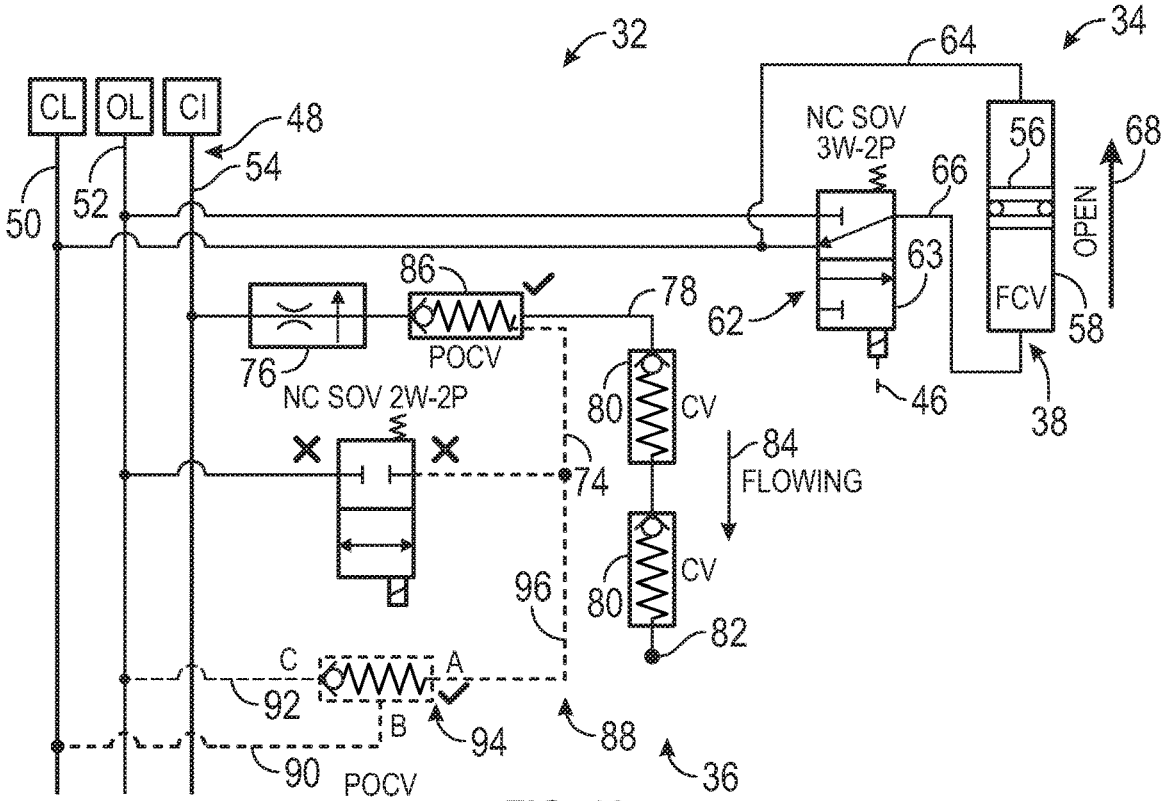
FIG. 13 is a schematic illustration similar to that of FIG. 11 but showing the operating module in a different operational position, according to an embodiment of the disclosure.

Referring generally to FIGS. 11, 12 and 13, another example of operating module 32 is illustrated. In this embodiment, the operating module comprises an electrically controlled flow circuit similar to that illustrated and described above with reference to FIGS. 4 and 5. However, the contingency circuit 88 has been added. The contingency circuit 88 may be used to stop and start chemical injection flow when electricity is not available.

According to an operational example, chemical injection in the contingency mode may be stopped by pressuring up open line 52 and flowing the pressurized actuating fluid through check valve 94. This ensures the pressure in hydraulic connector lines 96, 74 increases to close the pilot operated check valve 86 and to stop further chemical injection, as illustrated in FIG. 12. The pilot operated check valve 94 may then be allowed to close so as to maintain a trapped, increased pressure in hydraulic connector lines 96, 74. The trapped, increased pressure maintains the pilot operated check valve 86 in a closed position which prevents injection of chemicals.

To initiate injection of chemicals via mandrel 60 in the contingency mode, the close line 50 is pressured up sufficiently to open pilot operated check valve 94. The fluid trapped under increased pressure in hydraulic connector lines 96, 74 is then allowed to bleed off through depressurized open line 52. This allows the pilot operated check valve 86 to open under the pressure of injection fluid supplied via chemical injection line 54. Once the injection of chemicals through nozzle 82 is underway, as indicated by arrow 84 in FIG. 13, the pressure in close line 50 may be bled off. As with other embodiments including contingency circuit 88, chemical injection may be initiated and stopped even if electric line 46 is damaged or electrical power is otherwise unavailable to operate valve 70. In normal operations, the operating module 32 may be electrically operated to provide the desired chemical injection and/or shifting of actuator 56. However, the contingency circuit 88 enables control over injection even if electrical power becomes unavailable.

Figure 14:
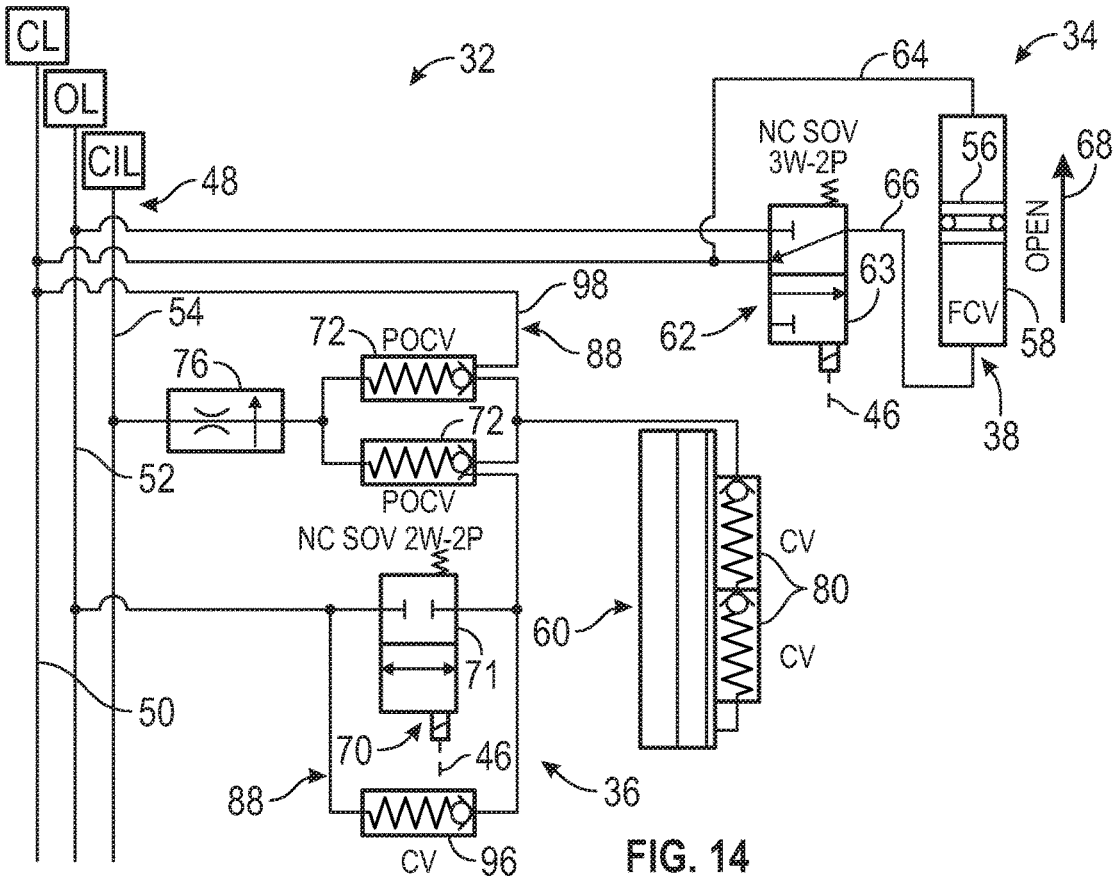
FIG. 14 is a schematic illustration of another example of an operating module coupled with an actuator and chemical injection device, according to an embodiment of the disclosure.
Figure 15:
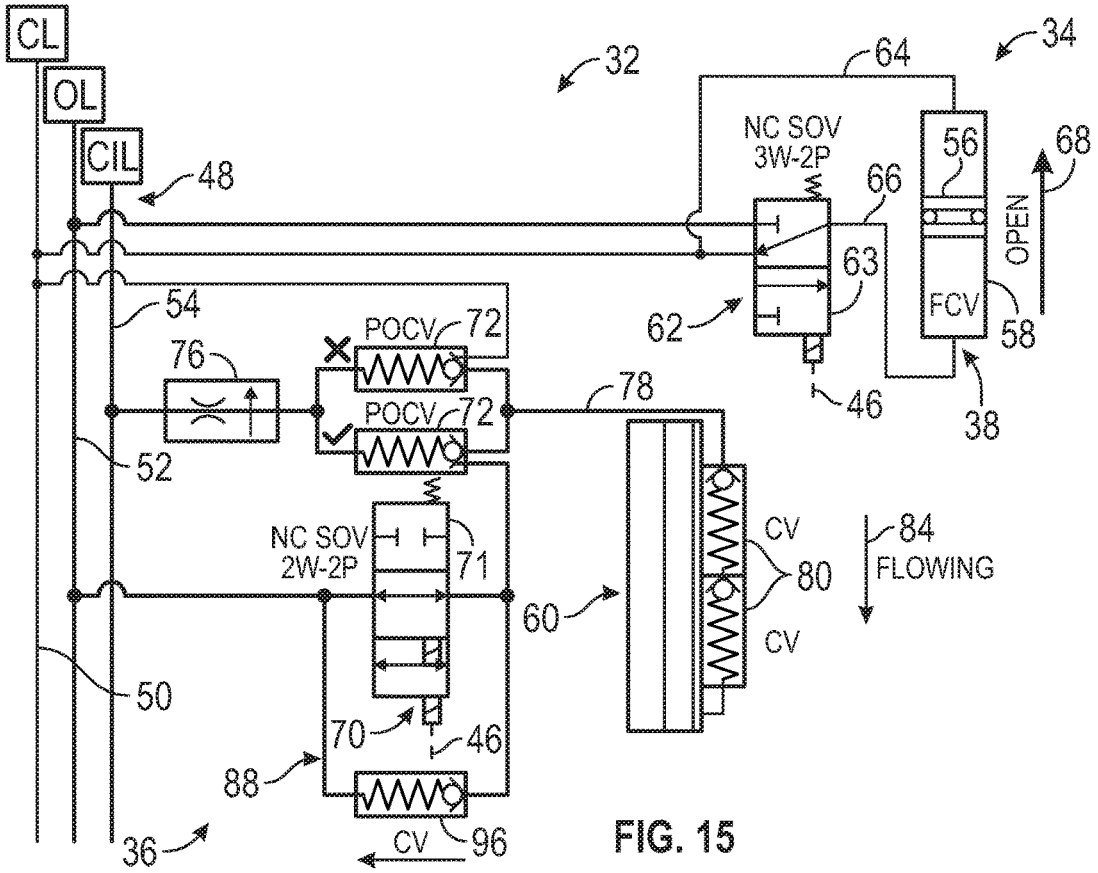
FIG. 15 is a schematic illustration similar to that of FIG. 14 but showing the operating module in a different operational position, according to an embodiment of the disclosure.
Figure 16:
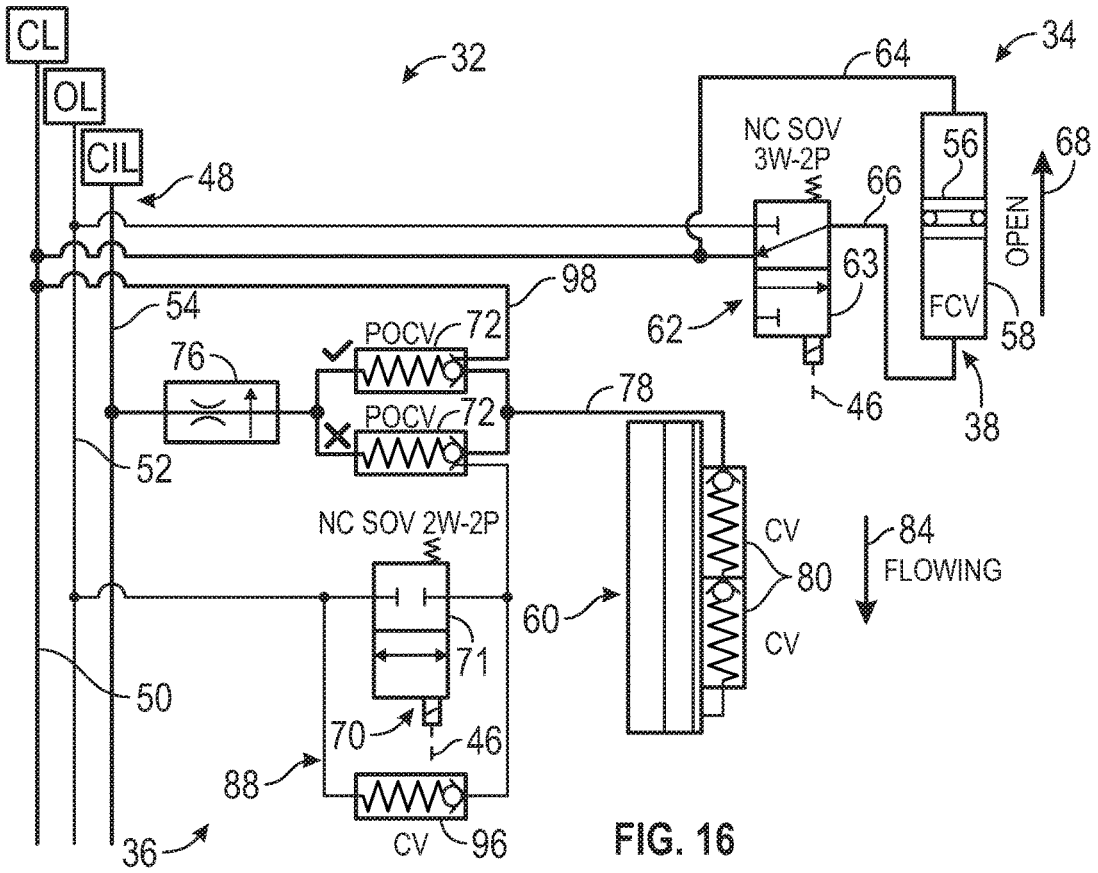
FIG. 16 is a schematic illustration similar to that of FIG. 14 but showing the operating module in a different operational position, according to an embodiment of the disclosure.

Referring generally to FIGS. 14, 15 and 16, another example of operating module 32 is illustrated. In this embodiment, the chemical injection system 36 comprises a pair of normally closed pilot operated check valves 72 in fluid communication with flow control device 76 and manifold 60. One of the check valves 72 also is in fluid communication with close line 50 and the other check valve 72 may be placed in fluid communication with open line 52 across electronically actuated valve 70 and across a check valve 96. Check valve 96 is coupled across the electronically actuated valve 70, e.g. across the normally closed two-way, two position solenoid operated valve 71.

According to an operational example, chemical injection may be initiated by pressuring up chemical injection line 54 and then open line 52. An appropriate electrical signal is then provided to actuate solenoid operated valve 71, as illustrated in FIG. 15. The higher pressure fluid flowing through valve 71 opens the lower illustrated pilot operated check valve 72 so that chemicals may flow through mandrel 60 for injection into the corresponding well zone. The solenoid operated valve 71 may then be de-energized while pressure is maintained in open line 52.

To stop the chemical injection, the pressure in open line 52 is bled off. As a result, the pressure acting to open the lower illustrated pilot operated check valve 72 is released through check valve 96. This allows the lower illustrated pilot operated check valve 72 to close and prevent further injection of the chemical injection fluid.

In this embodiment, the contingency circuit 88 is effectively provided by the upper illustrated pilot operated check valve 72. To begin injection without electrical power, the close line 50 is pressured up and the resulting higher pressure fluid is supplied to the upper illustrated pilot operated check valve 72 via hydraulic line 98, as illustrated in FIG. 16. While pressure in close line 50 maintains the upper illustrated pilot operated check valve 72 in the open position, the desired chemical or chemicals may be delivered therethrough for injection to the desired well zone. The chemical injection may be stopped simply by bleeding off the pressure in close line 50, thus allowing the upper illustrated pilot operated check valve 72 to transition to the closed position blocking further flow of chemical injection fluid.

Figure 17:
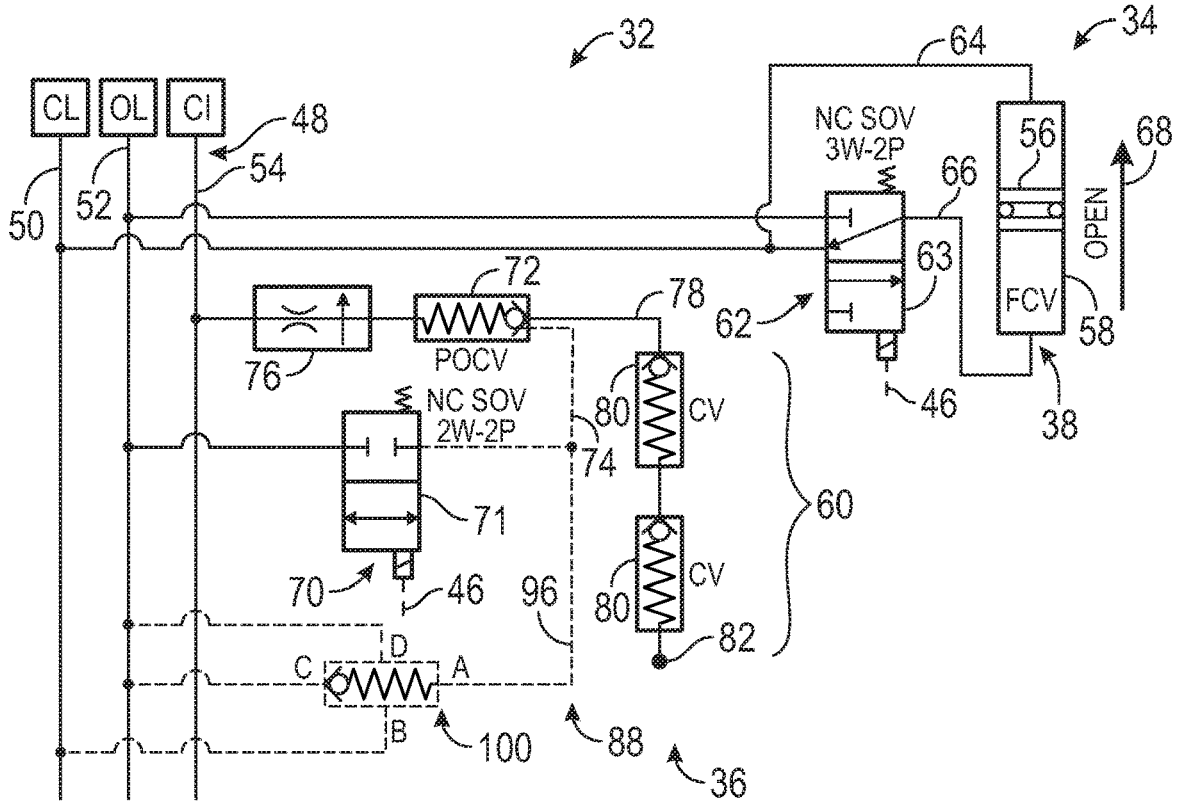
FIG. 17 is a schematic illustration of another example of an operating module coupled with an actuator and chemical injection device, according to an embodiment of the disclosure.
Figure 18:
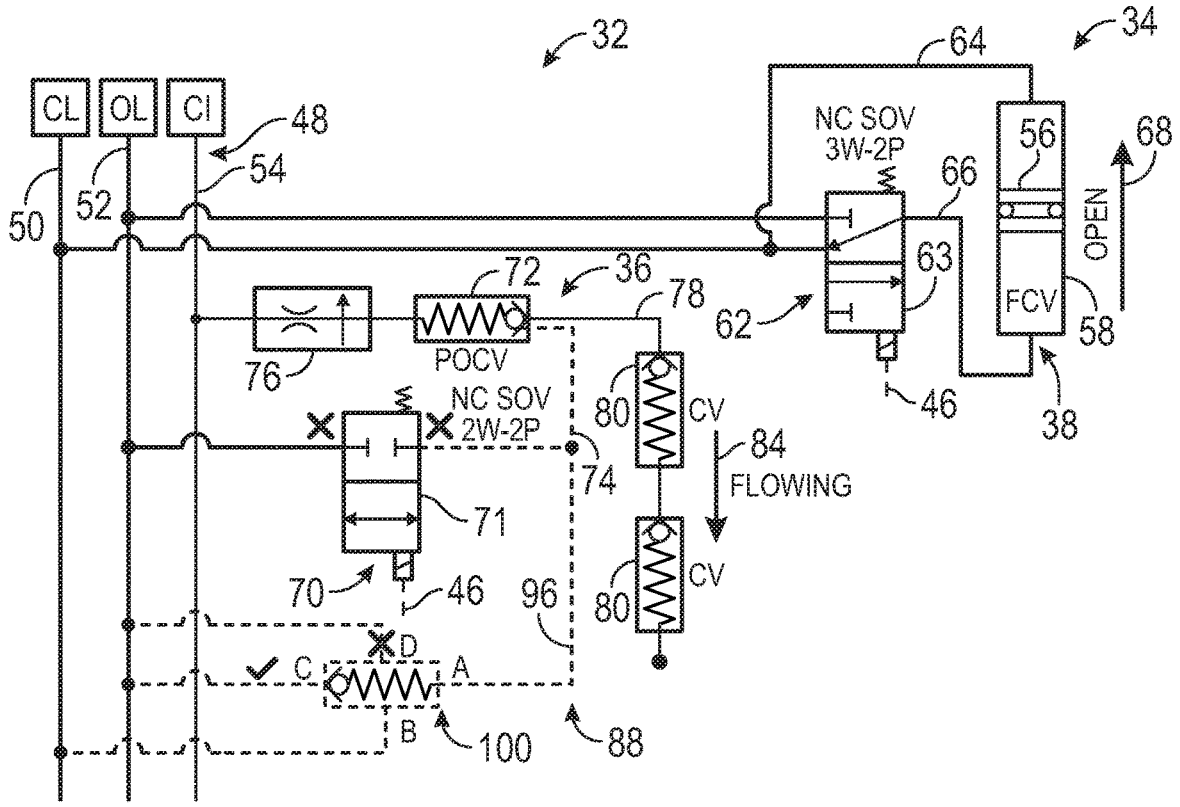
FIG. 18 is a schematic illustration similar to that of FIG. 17 but showing the operating module in a different operational position, according to an embodiment of the disclosure.

Referring generally to FIGS. 17 and 18, another example of operating module 32 is illustrated. In this embodiment, the operating module comprises an electrically controlled flow circuit similar to that illustrated and described above with reference to FIGS. 2 and 3. However, the contingency circuit 88 employs a sequence valve 100 having four ports A, B, C, D. When electrical power is available via electric line 46, the operating module 32 functions similar to that described above with respect to the embodiment illustrated in FIGS. 2 and 3 enabling independent operation of chemical injection and movement of actuator 56/flow control valve 58.

When electrical power is interrupted, however, the contingency mode may be employed to enable control over chemical injection by pressuring up the close line 50 while bleeding the open line 52. The differing pressures in close line 50 and open line 52 act on ports B, C, D to shift the sequence valve 100 to an open position. In the open position, the trapped fluid in hydraulic connector lines 96, 74 may be bled through the low pressure open line 52 so as to stop the chemical injection.

To resume chemical injection, a higher pressure is applied to the fluid in open line 52 and this higher pressure fluid is able to move through sequence valve 100 and out of port A so as to once again pressure up hydraulic connector lines 96, 74. The higher pressure in connector lines 96, 74 opens the pilot operated check valve 72 so that the injection of chemicals through check valve 72 and manifold 60 may be resumed as illustrated in FIG. 18. Once the desired chemical injection is established, the close line 50 and open line 52 may be bled while sequence valve 100 maintains pressure in connector lines 96, 74. At this stage, independent operation of the actuator 56/flow control valve 58 may be resumed.

Figure 19:
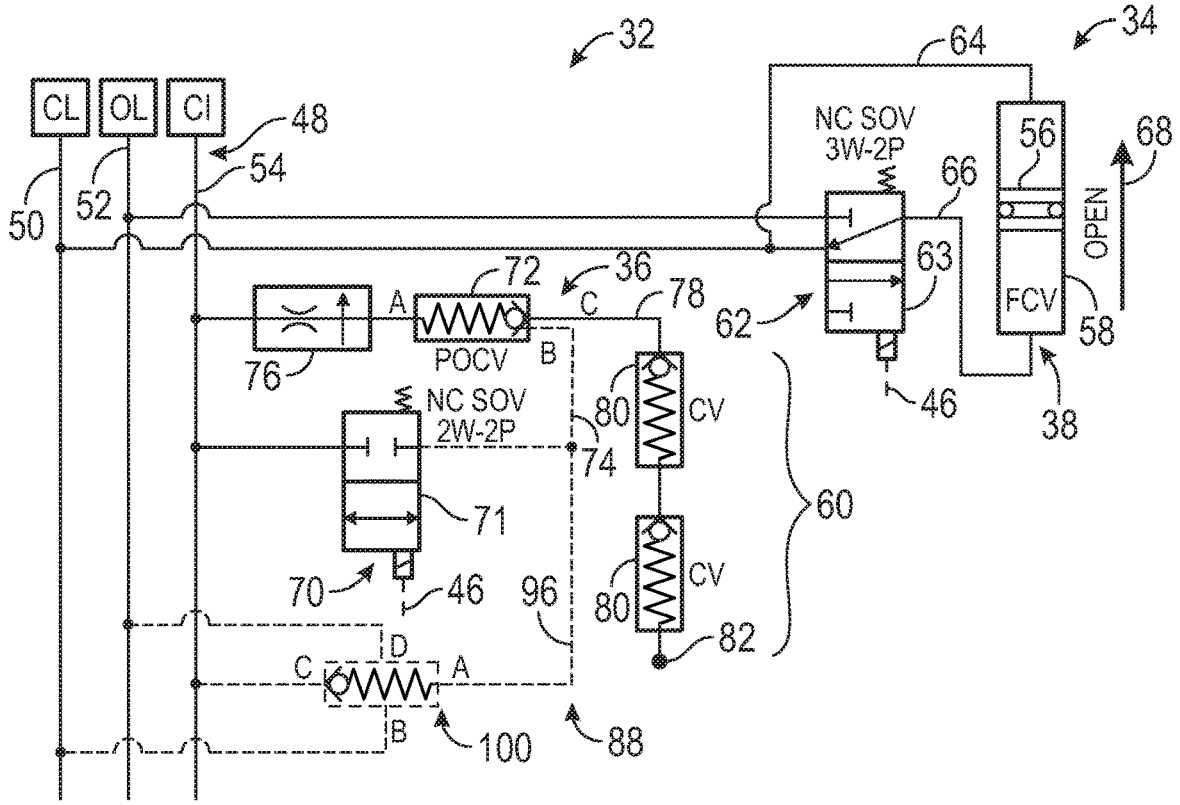
FIG. 19 is a schematic illustration of another example of an operating module coupled with an actuator and chemical injection device, according to an embodiment of the disclosure.
Figure 20:
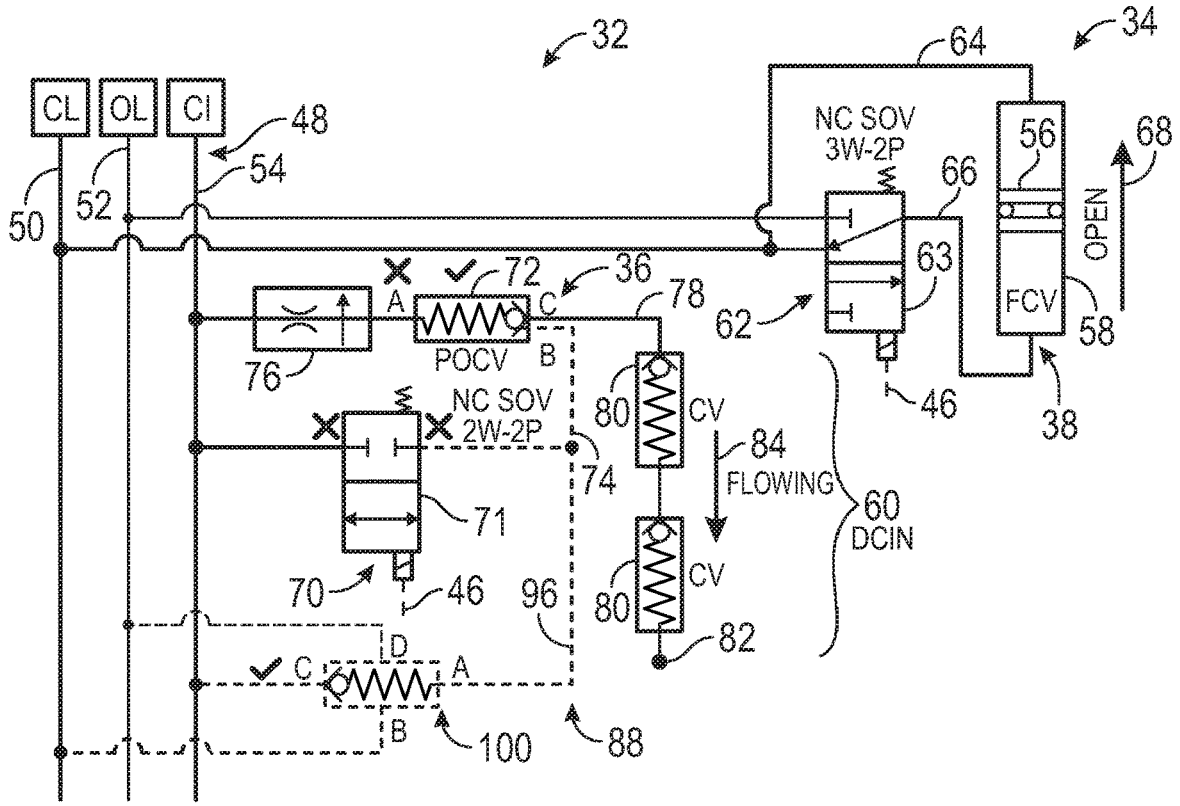
FIG. 20 is a schematic illustration similar to that of FIG. 19 but showing the operating module in a different operational position, according to an embodiment of the disclosure.

Referring generally to FIGS. 19 and 20, another example of operating module 32 is illustrated. In this embodiment, the operating module comprises an electrically controlled flow circuit similar to that illustrated and described above with reference to FIGS. 6 and 7. However, the contingency circuit 88 employs sequence valve 100. When electrical power is available via electric line 46, the operating module 32 functions similar to that described above with respect to the embodiment illustrated in FIGS. 6 and 7 enabling independent operation with respect to chemical injection and movement of actuator 56/flow control valve 58. As with certain other embodiments described herein, the sequence valve 100 may be closed to enable independent actuation of actuator 56.

When electrical power is interrupted, however, the contingency mode may be employed to enable control over chemical injection. To stop the chemical injection, the chemical injection line 54 may be bled. Subsequently, close line 50 is pressured up to an appropriate pressure level while the open line 52 is bled. The action of pressuring close line 50 and bleeding open line 52 causes sequence valve 100 to open so the trapped volume of fluid in hydraulic connector lines 96, 74 may be bled through sequence valve 100 and chemical injection line 54. The consequent reduction of pressure in hydraulic connector lines 96, 74 closes the pilot operated check valve 72 so as to prevent any further injection of chemicals.

To resume injection of chemicals through mandrel 60, the chemical injection line 54 and close line 50 are pressured up which, in turn, opens the sequence valve 100 to enable application of the higher pressure in hydraulic connector lines 96, 74. As a result, the pilot operated check valve 72 opens once again to enable flow of chemical injection fluid therethrough and ultimately out through nozzle 82 as indicated by arrow 84 in FIG. 20. Subsequently, the pressure in close line 50 may be bled to enable closure of sequence valve 100 so as to trap the higher pressure fluid in hydraulic connector lines 96, 74. This higher pressure maintains pilot operated check valve 72 in an open flow configuration for continued flow of the injection chemical(s).

Figure 21:
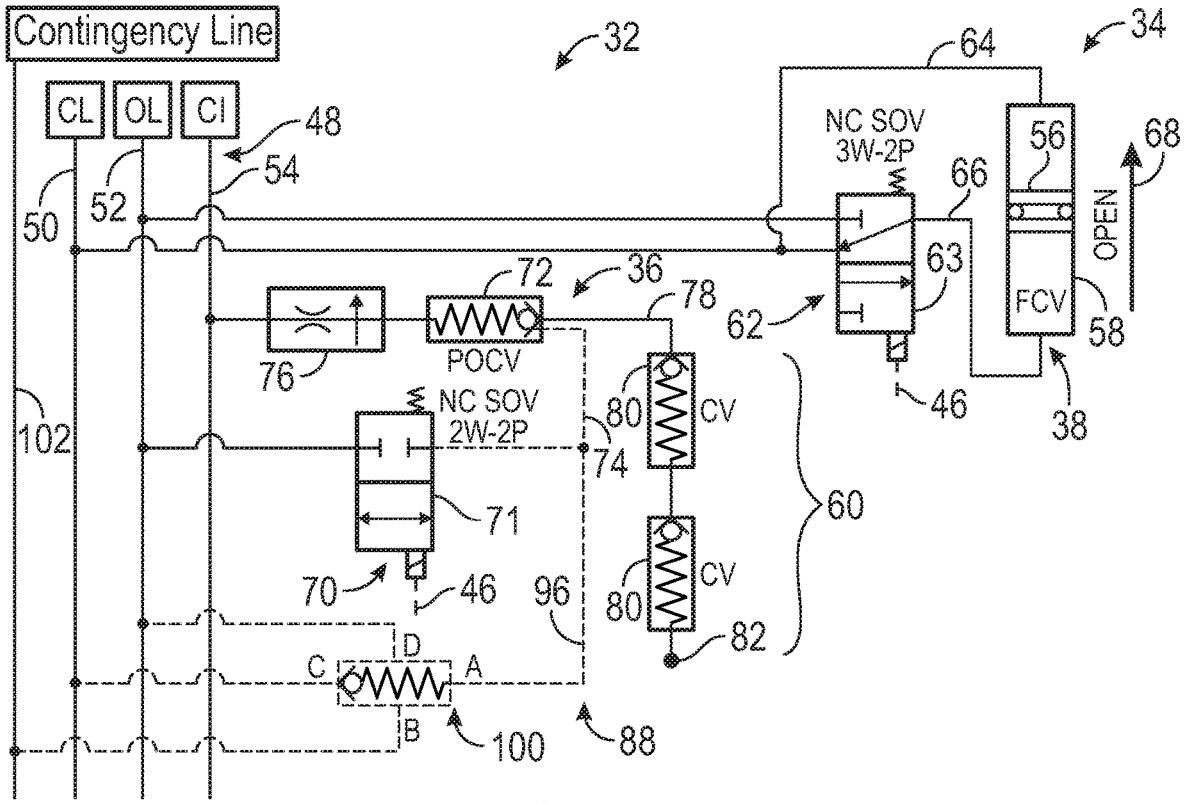
FIG. 21 is a schematic illustration of another example of an operating module coupled with an actuator and chemical injection device, according to an embodiment of the disclosure.
Figure 22:
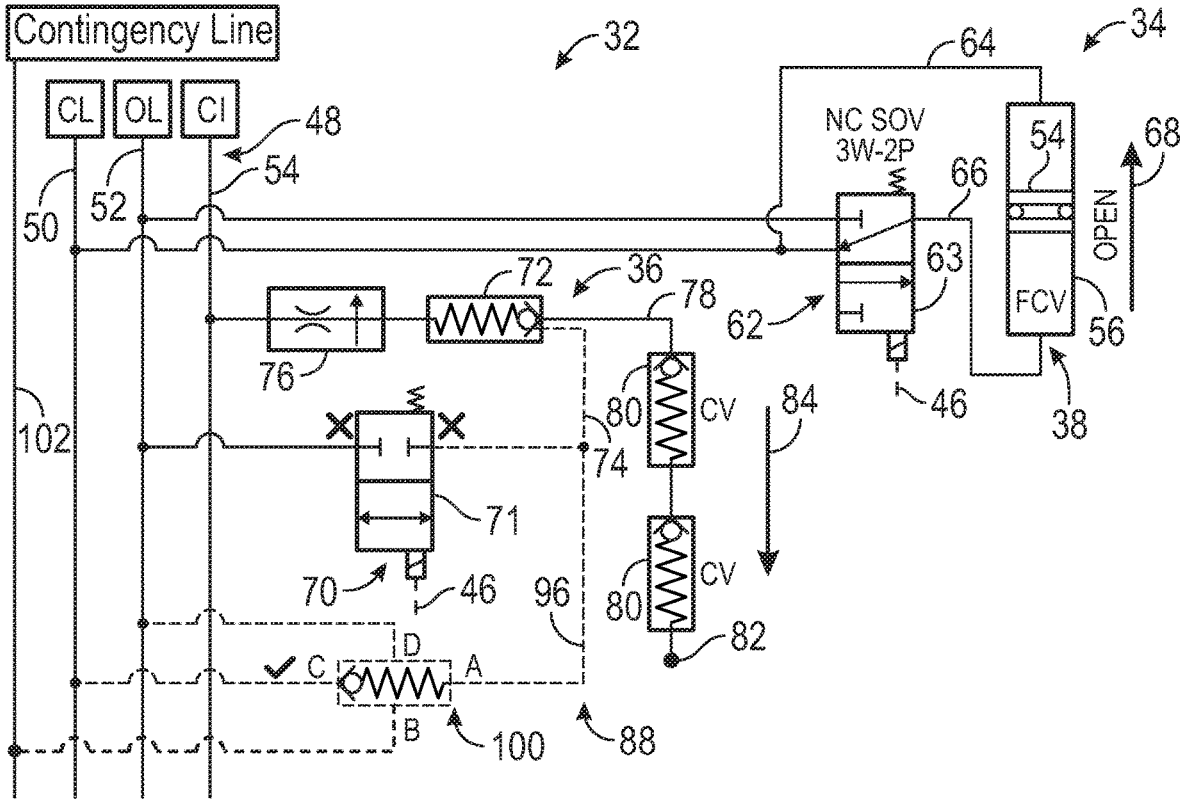
FIG. 22 is a schematic illustration similar to that of FIG. 21 but showing the operating module in a different operational position, according to an embodiment of the disclosure.

Referring generally to FIGS. 21 and 22, another example of operating module 32 is illustrated. In this embodiment, the operating module comprises an electrically controlled flow circuit similar to that illustrated and described above with reference to FIGS. 6 and 7. However, the contingency circuit 88 employs sequence valve 100 in combination with a dedicated contingency hydraulic line 102. When electrical power is available via electric line 46, the operating module 32 functions similar to that described above with respect to the embodiment illustrated in FIGS. 6 and 7 enabling independent operation of chemical injection and movement of actuator 56/flow control valve 58. As with certain other embodiments described herein, the sequence valve 100 may be closed to enable independent actuation of actuator 56.

When electrical power is interrupted, however, the contingency mode may be employed to enable control over chemical injection. To stop the chemical injection, the contingency hydraulic line 102 is pressured up to open sequence valve 100 so the trapped volume of fluid in hydraulic connector lines 96, 74 may be bled through sequence valve 100 and close line 50. The consequent reduction of pressure in hydraulic connector lines 96, 74 closes the pilot operated check valve 72 so as to prevent any further injection of chemicals.

To resume injection of chemicals through mandrel 60, the chemical injection line 54 and contingency line 102 are pressured up which, in turn, opens the sequence valve 100 to enable application of the higher pressure in hydraulic connector lines 96, 74. As a result, the pilot operated check valve 72 opens once again to enable flow of chemical injection fluid therethrough and ultimately out through nozzle 82 as indicated by arrow 84 in FIG. 22. Subsequently, the pressure in contingency line 102 may be bled to enable closure of sequence valve 100 so as to trap the higher pressure fluid in hydraulic connector lines 96, 74. This higher pressure maintains pilot operated check valve 72 in an open flow configuration for continued flow of the injection chemical(s) and independent operation of actuator 56.

The overall system 30 may have a variety of components and configurations. For example, system 30 may be constructed as a well system comprising numerous types of well components, e.g. completion components, for use in a variety of well environments. Additionally, various numbers of operating modules 32, hydraulic actuation systems 34, chemical injection systems 36, and actuatable devices 38, e.g. flow control valves, may be used along various types of tubing strings in well applications and non-well applications.

Similarly, various hydraulic circuit layouts may be used in actuation systems 34 and chemical injection systems 36. The actuation system 34 and chemical injection system 36 may be arranged in separate modules or combined in single modules for use in controlled chemical injection applications and/or actuator positioning applications. Similarly, various types of valves 62, 70, pilot operated check valves, check valves, flow passageways, and other flow components may be used in the actuation system 34 and chemical injection system 36 of each operating module 32. The electric line 46 and the hydraulic lines, e.g. hydraulic lines 50, 52, 54, 102, may be routed along tubing strings or other equipment in various patterns and forms able to deliver the appropriate electric signals, hydraulic signals, and chemical injection fluids. In some applications, the electric line and/or hydraulic lines may be incorporated into well equipment to provide a signal path along the interior or within the walls of the well equipment. In other applications, the electric line and/or hydraulic lines may be combined in a cable routed downhole and coupled with the one or more operating modules 32.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a plurality of operating modules, each operating module being coupled with a corresponding actuator system and a corresponding chemical injection system, each operating module being controllable to enable selective movement of a corresponding tool actuator via the corresponding actuator system and injection of a chemical via the corresponding chemical injection system, and each operating module comprising a first solenoid operated valve operable via electric power to cause actuation of the corresponding tool actuator and a second solenoid operated valve operable via electric power to enable injection of the chemical via the corresponding chemical injection system; and a surface control system coupled with the plurality of operating modules via a plurality of hydraulic lines including at least one chemical injection line.

2. The system as recited in claim 1, wherein each of the operating modules of the plurality of operating modules is positioned at a different well zone along a wellbore.

3. The system as recited in claim 1, wherein the corresponding tool actuator is part of a flow control valve shiftable between different flow positions.

4. The system as recited in claim 1, wherein electrical power is provided to the first and second solenoid operated valves via an electric line coupled with the surface control system.

5. The system as recited in claim 1, wherein the plurality of hydraulic lines comprises an open hydraulic line, a close hydraulic line, and the at least one chemical injection line routed from the surface control system.

6. The system as recited in claim 1, wherein each operating module comprises a normally closed pilot operated check valve.

7. The system as recited in claim 1, wherein each operating module comprises a normally open pilot operated check valve.

8. The system as recited in claim 1, wherein each operating module comprises two pilot operated check valves.

9. A system, comprising:

a well system deployed downhole in a wellbore and coupled with a control system via a plurality of hydraulic lines, the plurality of hydraulic lines comprising one open hydraulic line, one close hydraulic line, and one chemical injection line, the well system comprising:

a plurality of operating modules disposed in corresponding well zones along the wellbore, each operating module being coupled with a corresponding actuator and a corresponding chemical injection device, each operating module being controllable via electrical signals to enable selective movement of the corresponding actuator and injection of a chemical via the corresponding chemical injection device, and the open hydraulic line, the close hydraulic line, and the chemical injection line coupled to each of the plurality of operating modules.

10. The system as recited in claim 9, wherein the electrical signal is provided via an electric line extending downhole from the control system.

11. The system as recited in claim 9, wherein the control system is a surface control system.

12. The system as recited in claim 9, wherein each operating module comprises a normally closed pilot operated check valve.

13. The system as recited in claim 9, wherein each operating module comprises a normally open pilot operated check valve.

14. A method, comprising:

providing a well system with a plurality of operating modules coupled with corresponding actuators and chemical injection modules;

conveying the well system downhole to a desired location in a borehole;

selectively shifting operating modules of the plurality of operating modules via electrical input to enable a desired injection of a chemical via the chemical injection module and actuation of the actuator, wherein selectively shifting comprises using one or more check valves in each operating module; and controlling the selective shifting of the operating modules via a control system, an electric line, and a plurality of hydraulic lines, the plurality of hydraulic lines comprising one open hydraulic line, one close hydraulic line, and one chemical injection line.

15. The method as recited in claim 14, wherein selectively shifting comprises electrically actuating at least one of a plurality of solenoid operated valves in each operating module.

16. The method as recited in claim 14, wherein selectively shifting further comprises using one or more solenoid operated valves in each operating module.

* * * * *